United States Patent [19]

Jenkins

[11] Patent Number: 4,756,468

[45] Date of Patent: Jul. 12, 1988

[54] WINDOWED MAILER WITH TUMBLE-STYLE RETURN ENVELOPE FOR REMITTANCE DOCUMENT, HAVING RETURN MAIL-TO ADDRESS EXPOSED BY REMOVAL OF APERTURED COVER

[75] Inventor: Richard A. Jenkins, Wheeling, Ill.

[73] Assignee: Moore Business Forms, Inc., Glenview, Ill.

[21] Appl. No.: 17,078

[22] Filed: Feb. 20, 1987

[51] Int. Cl.[4] ..... B65D 27/06

[52] U.S. Cl. ..... 229/73; 229/69

[58] Field of Search ..... 229/73, 69, 92.3, 92, 229/68 R

[56] References Cited

U.S. PATENT DOCUMENTS

| | | | |
|---|---|---|---|
| 2,941,711 | 4/1960 | Biek | 229/73 |
| 3,652,007 | 1/1972 | MacDougall | 229/73 |
| 3,802,618 | 7/1974 | Wiessner | 229/73 |

OTHER PUBLICATIONS

Moore Business Forms, Inc. Brochure "The Moore Speediseal System–Print, Process, Post", 4 pages, n.d.

Moore Business Forms, Inc. Brochure "4200 Speedisealer", 2 pages, 11/83.

Moore Business Forms, Inc. Brochure "4600 Speedisealer", 2 pages, 11/83.

*Primary Examiner*—Willis Little

*Attorney, Agent, or Firm*—Cushman, Darby & Cushman

[57] ABSTRACT

The recipient of a mailer, following pre-printed instructions, severs a marginal portion in order to separate a cover sheet, through a window of which the initial mail-to address label was visible, from a return envelope which, except for the initial mail-to address, has an upside-down orientation relative to the mailer. The recipient then turns the return envelope right-side-up which places the initial mail-to address in the upper left hand corner, upside down, as a from address, and places the return mail-to address (which was formerly hidden, in an inverted orientation, by the cover sheet, right-side-up in a customary position. The recipient then detaches a remittance document from the separated cover sheet and places it in the return envelope, e.g. together with a bank check or other form of payment, seals the return envelope and mails it back.

18 Claims, 3 Drawing Sheets

WINDOWED MAILER WITH TUMBLE-STYLE RETURN ENVELOPE FOR REMITTANCE DOCUMENT, HAVING RETURN MAIL-TO ADDRESS EXPOSED BY REMOVAL OF APERTURED COVER

BACKGROUND OF THE INVENTION

Business usage of a mailer containing a return envelope is an advantageous method for distributing information which requires remittance. There are several methods of design and manufacture which provide for combining of the information piece, outgoing envelope, and return envelope into one document.

One such method of design utilizes the following principles of manufacture.

1. A two sheet construction, in which the back sheet is full width, and the front sheet terminates at a point which is one-half the width of the full sheet.

2. The two sheets are joined by cold glue (adhesive) along the extreme outside edges (side, top and bottom), in order to hold them together as the form is computer imaged and subsequently processed through the mail.

3. The two sheets are additionally joined by a U-shaped cold glue pattern (at left, right and bottom), to form an envelope, to be used by the recipient of the mailer to return a remittance such as payment of a bill. The narrow sheet is also provided with a horizontal strip of rewettable glue, applied to the back of the sheet's top edge, providing a means for sealing the return envelope.

4. The portion of the wide sheet not joined to the narrow sheet contains area for preprinted material, as well as area for information to be imaged by a computer printer. There may also be provided perforations to remove a section of the document, which section serves as account identification, confirmation, etc. This sheet also contains a die cut, covered with a glassine material. The back of this portion of the sheet is preprinted with information pertaining to the return address of the initial mailer, and additionally may include preprinted postal metering or indicia.

5. Around the top, right and bottom edges of the sheet is applied, during manufacture of the form, a "reverse C" pattern of reheatable adhesive, the purpose of which will soon be described.

Upon delivery, from the manufacturer, of a continuous web of such documents, the usage of such forms is as follows:

1. The form web is imaged by a computer printer. On the face of the narrow sheet, the intended recipient,s name and address (Outgoing Mail To) is printed in such a position that it is above and to the left of the preprinted name and address of the party to whom the return envelope will be mailed (Return Mail To). This arrangement allows the computer-printed information to serve a dual purpose—"Mail To" for the outgoing mailing, and "From" for the return mailing.

2. The portion of the form not containing the return envelope is imaged by computer printer.

3. After imaging is completed, the forms are then folded upon themselves (left over right) allowing the "Mail To" address to appear through the die cut/glassine on the right half of the form. The forms are then detached and processed through a heat seal device, in one operation, thus melting the glue in the outer perimeter and sealing the document.

4. The forms are now ready for distributing through the Postal Service.

Upon receiving the document, the recipient first opens the document by removing three edges, previously perforated during manufacturing. The recipient then separates the left and right portions, by means of a perforation, and further separates the return portion, and encloses it into the provided return envelope, along with a bank check, in many cases.

This practice, while extremely efficient from the viewpoint of the initial mailer, recipient, and ultimate recipient of the return mailing, presents at least two concerns:

(1) the arrangement of two addresses on the face of one envelope can be extremely confusing to the Postal Service, and in many cases does not conform to regulations which allow a discount for mailing;

(2) the arrangement of the Mail To address (Outgoing Envelope) requires that the die cut/glassine patch on the opposite half of the form be positioned in such a manner that the design of a return document which can be processed by Optical Character Reader equipment is extremely difficult, if not impossible, to achieve.

For these reasons, another idea has been devised and put into practice. In this second configuration, a hinged, or Flip Window, is incorporated into the form during manufacture. This device is manufactured in such a way that is it hinged backward and down, and delivered to the initial mailer in this fashion. The original recipient,s name and address (Outgoing Mail To) is computer printed on this flip window, while the Remit To (Return Mail To) information is imaged (during manufacture or by computer imaging) on the portion serving as the return envelope.

After computer imaging, the Flip Window is flipped closed during further processing, then the forms are processed as in the previously discussed practice. Recipient an remittance usage also are as in the previously discussed practice. This practice has several advantages for the initial mailer, Postal Service and recipient of the return mailing.

The use of the Flip Window removes the outgoing address from the return envelope. This allows the initial mailing party to position both addresses in such a manner that the document may be processed more efficiently by the Postal Service. This can result in a discount of the postage fee, as well as faster delivery and return, thus possibly increasing cash flow for the business. Additionally, the Flip Window can be positioned in a location which provides for a return document processible by Optical Character Reader (OCR) equipment, thus increasing the rate of processing remittances.

This prior art, however, presents some concerns, primarily during manufacturing stages. Use of the flip window on such a mailer can lead to problems if the manufacturer does not monitor to make sure that all of the window flaps have been rotated to the desired position prior to delivery to the initial mailer.

In addition, the flip window usually is limited by existing maufacturing constraints to a 2-$\frac{3}{4}$ inch maximum width, which does not allow sufficient space for data entry in a fair number of cases, e.g. where the given and family names of two individuals are to be listed on the name line, or where the street address line must also contain a long building, floor or suite identifier, or more than one of these. During the mailer manufacturing process, the technique currently used for flipping-open the die-cut hinged window flap takes more time than preceding or succeeding steps, so that it acts as a bottleneck on the production line. And, so far, too few businesses which could profitably make use of thi.s type of mailer have seen their way clear to invest in the type of computerized printing apparatus for printing variable data on one face of the corresponding part of the mailer, including on the temporarily exposed face of the flipped-open window flap.

SUMMARY OF THE INVENTION

The recipient of a mailer, following pre-printed instructions, severs a marginal portion in order to separate a cover sheet, through a window of which the initial mail-to address label was visible, from a return envelope which, except for the initial mail-to address, has an upside-down orientation relative to the mailer. The recipient then turns the return envelope right-side-up which places the initial mail-to address in the upper left hand corner, upside down, as a from address, and places the return mail-to address (which was formerly hidden, in an inverted orientation, by the cover sheet, right-side-up in a customary position. The recipient then detaches a remittance document from the separated cover sheet and places it in the return envelope, e.g. together with a bank check or other form of payment, seals the return envelope and mails it back.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
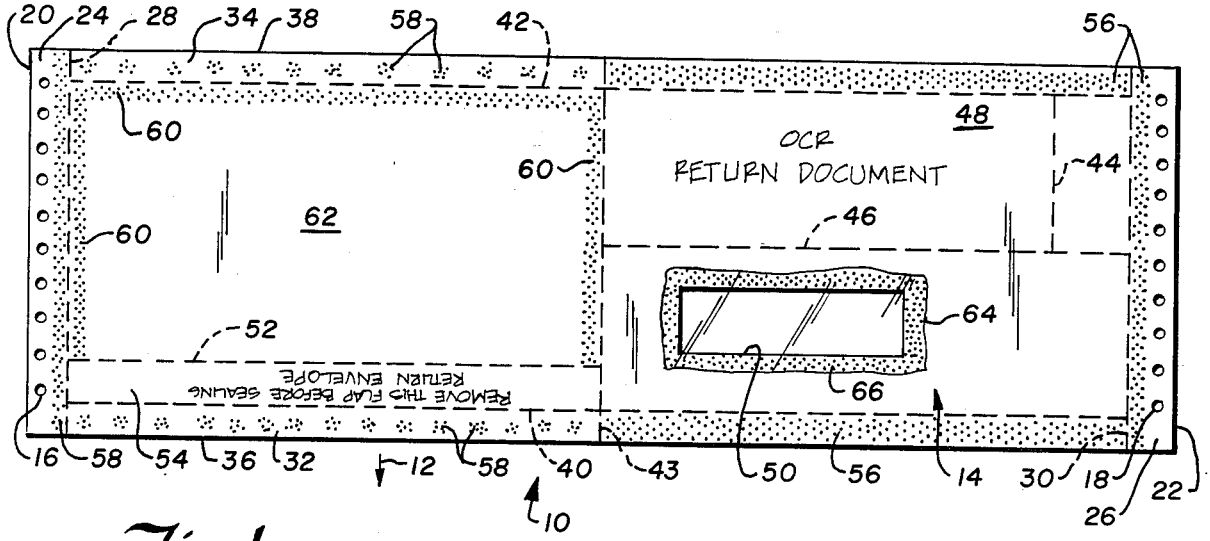
FIG. 1 is a front elevation view of a segment of web stock corresponding to a first sheet of one mailer embodying principles of the present invention.

The stock for the mailer of the present invention most advantageously is manufactured out of indeterminate length webs of paper or the like which is furnished to the business or other institution in boxes or rolls containing a succession of serially connected segments, each of which will become an individual mailer. This stock usually has been pre-printed by the form stock manufacturer with most or all of the non-varying information which is to appear on each mailer, and the business or other institution, using a production line which may include a computerized printer, folder, heat sealer and severing device applies the varying information successively to each increment of the stock, folds the stock along a longitudinal line and heat-seals the two folded leaves together, and transversally severs the resulting composite into individual mailers ready for mailing. Many variables may be changed without departing from the principles of the invention, e.g. certain businesses or other institutions may wish to obtain the form stock already severed into individual segments.

For convenience in description, the preparation and use of a single mailer will be described in detail. However, the description should be understood with the above-mentioned possibilities in mind.

The front of a segment of the first sheet of the form stock is shown in its initial, unfolded condition at 10; the longitudinal direction of the web from which this segment was produced is indicated by the arrow 12.

(The term "front", and other terms, such as "top", "left" and the like are used fairly arbitrarily herein, in reference to the various elements as they happen to be oriented in the drawing figures. No spatial limitation is intended by such reference, unless one appears from the context to be essential for successful use. The face 14 of the segment of the first sheet 10 which has just been designated the "front", is the one which will at a later stage be folded along a longitudinal line to become the inside of the outer wrapper of the mailer.)

The segment 10 is shown made from a full-width web, so that it has a respective row of sprocket-receiving holes 16, 18 bordering its left edge 20 and its right edge 22, each of these rows being segregated onto a marginal strip 24, 26 by a respective longitudinally-running line of weakness 28, 30, e.g. a respective perforation line. Medially, the first sheet 10 is shown provided with a third longitudinal line of weakness 43(also, and like all of the others which will be described, typically being a line of perforations). In a similar manner top and bottom marginal strips 32, 34 are defined bordering the top and bottom edges 36, 38 of the sheet 10 by respective lines of weakness 40, 42.

The medial line of weakness 43 divides the region of the sheet 10 bounded by the marginal strips 24, 26, 32, 34 into a left half and a right half (or more generically, a "first portion" and a "second portion"). The right half, which is printed on this face in inverted relation to the left half and to its own opposite face, is shown in FIG. 1 provided with a fourth longitudinal line of weakness 44 and a third transverse line of weakness 46, respectively positioned so as to define, together with the medial line of weakness 43 and the lower marginal strip-defining transverse line of weakness 40, a region 48, which, when later severed along those four lines of weakness will become a remittance document which is tall and wide enough to be read by a standard optical character reader, yet short and narrow enough to fit in the return envelope (to be described) without needing to be folded in either direction.

Figure 7:
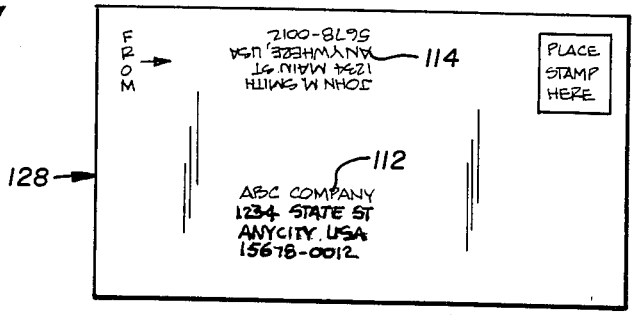
FIG. 7 is a front elevational view of the return envelope ready to be mailed to the return send-to address.
Figure 5:
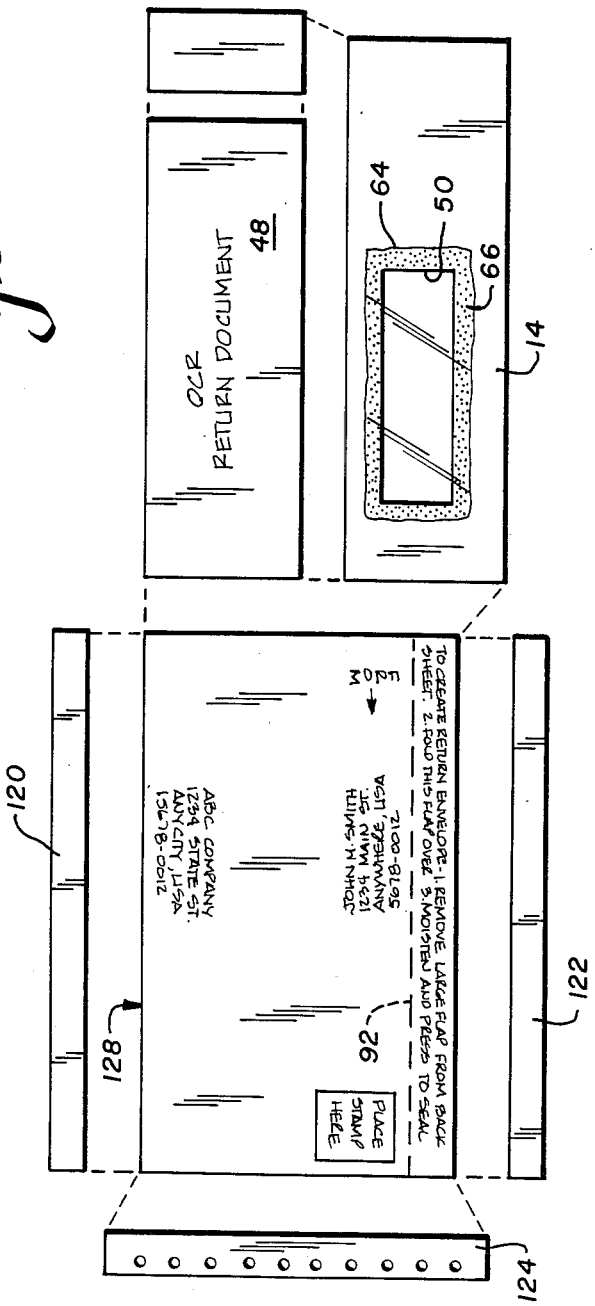
FIG. 5 is a perspective view of the mailer as opened in accordance with instructions, the user having detached the OCR-readable remittance document.

In relation to the site where the lines of weakness 44 and 46 cross in FIG. 1, the potential remittance document 48 occupies the northeastern quadrant. The southeastern quadran is shown provided with a die-cut window aperture 50 elongated transversally of the web and having a standard size, shape and location. (I.e. on the completed mailer, as seen from the outside (FIG. 7), the window 50 will appear at the lower right, at a site suitable for having an address read therethrough by OCR and ZIP+4 automated mail sorting and routing equipment meeting existing USPS standards.)

Continuing to refer to FIG. 1, the first portion, i.e. the left portion of the first sheet 10 is shown additionally provided with a fourth transverse line of weakness 52. It is spaced below the upper marginal strip-defining transverse line of weakness 40 by a small distance sufficient to define a discard strip 54, which the user will later tear off in order to expose the glued side of the return envelope glue flap (to be described), for folding down over the mouth of the envelope which mouth will be in part defined by the edge created at 52 when the discard strip 54 is torn off.

The right portion of the sheet 10 is shown provided on the top, right and bottom marginal strips with a medially-open, squared C-shaped band 56 of heat sealable adhesive. (This will be activated at a later stage (to be described) to close the folded form stock on itself to complete an individual mailer.)

The left portion of the sheet 10 is shown provided with two squared C-shaped bands of adhesive e.g. cold adhesive, including a first medially-open band 58 provided on the upper, left and lower marginal strips, and a second upwardly-open band 60 provided about the perimeter of the return envelope rear panel 62 which is delimited by the medial line of weakness 43, the lower marginal strip-defining line of weakness, and the potential return envelope mouth-defining line of weakness 52. (The outer band 58 will be used by the forms manufacturer to marginally plate a second sheet (to be described) to the first sheet, and the inner band 60, which is embraced by the outer band, will be used by the forms manufacturer to marginally secure three margins of the front panel of the return envelope portion of the second sheet to the first sheet, as will be described.)

In some instances, it will be acceptable for the window aperture 50 to remain open. In others, it is preferable or essential, whether for security, or for avoidance of processing problems that the window aperture 50 be glazed, e.g. by a patch 64 of glassine or other transparent, translucent or clear flexible sheet material, e.g. perimetrically glued by a band of adhesive 66 to the sheet 10, e.g. using the same type of adhesive as is used at 58, 60, the window in such an instance being glazed prior to application of the glue band 56 in order to avoid prematurely heat activating the latter while glazing the window 50.

Figure 2:
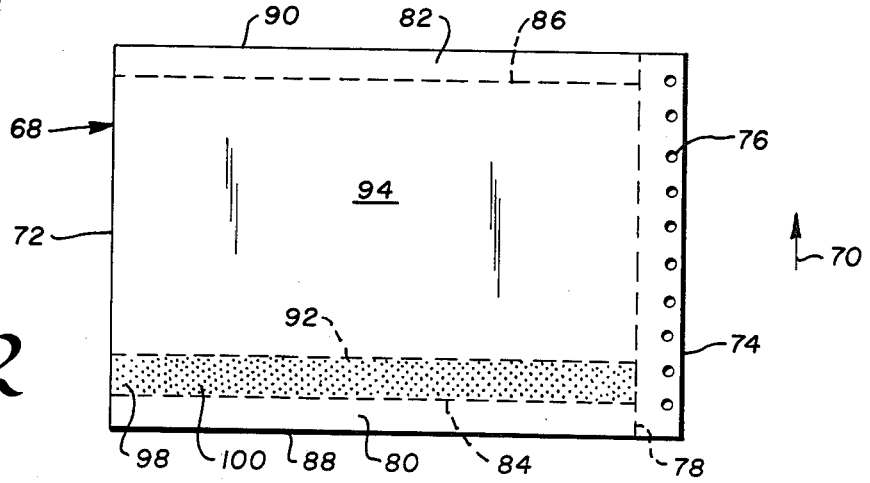
FIG. 2 is a rear elevational view of a segment of web stock corresponding to a second sheet of the one mailer.

FIG. 2 depicts a rear elevational view of a second sheet 68 for the mailer, this sheet being constituted by a respective segment of a web having a longitudinal direction indicated by the arrow 70. The second sheet 68 is as tall as, but only half as wide as the first sheet 10. It is designed to be superimposed on the first sheet 10 so that its right marginal edge 72 coincides with the medial line of weakness 43 and its left marginal edge 74 coincides with the left marginal edge of the first sheet 10. (It should be borne in mind that FIG. 2 and the left half of FIG. 1 show the faces of the two respective sheets which will confront one another as the form stock is manufactured. Accordingly, the terms "left" and "right" are used in regard to the second sheet consistently with the FIGS. 1 and 3 orientations of the second sheet, rather than with the orientation which is shown in FIG. 2.)

The second sheet 68 is shown provided with a row of sprocket holes 76 on its left marginal strip, which is delimited by a longitudinal line of perforations 78. Top and bottom transverse marginal strips 80, 82 are delimited by respective transverse lines of perforations 84, 86 and top and bottom edges 88, 90. All of the foregoing features are sized and placed to correspond thicknesswise of the form stock with the corresponding features of the left portion of the first sheet 10 as depicted in FIG. 1.

In addition, the second sheet 68 is shown provided with a transverse line of weakness 92 which divides the panel 94 which will form the front panel of the return envelope from the strip which will form the fold over and seal glue flap 98 of the return envelope. The glue flap 98 is shown provided on its rear face with a transversally extending band of rewettable adhesive 100.

Figure 3:
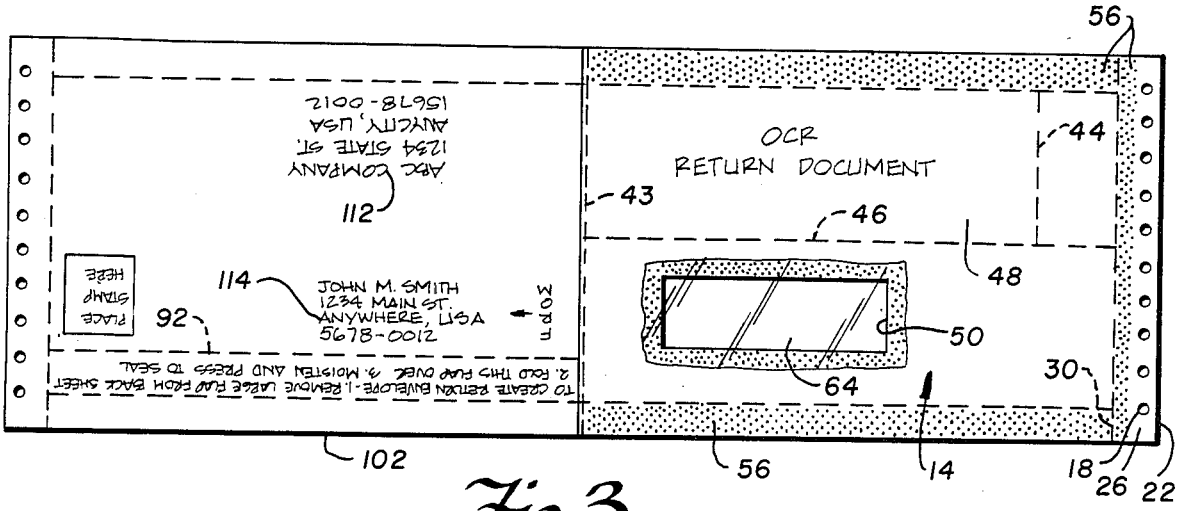
FIG. 3 is a front elevation view of a not-yet-folded mailer created by assembly of the components shown in FIGS. 1—3.

The first and second sheets of the form stock are plated together to produce the composite 102 shown in FIG. 3, by registering the second sheet with the left portion of the first, and pressing the two together while the hot melt adhesive of the bands 58, 60 is in a heat-activated state.

The forms manufacturer may print the return send-to address 112 directly on the front of the return envelope front panel, in a usual location, as shown, where it is available, when exposed, to be read manually, and by an OCR. It should be noted that this return send-to address is positioned to be totally out of registry with the aperture 50 when the mailer is in its FIG. 4 condition.

The business or other institution which is the forms manufacturer's customer receives the product in the form which is illustrated in FIG. 3 (except that it may be in the form of a composite web of indeterminate length, and the form stock may or may not be already pre-folded on the medial line of weakness 43).

The business or other institution variably prints on the face of the composite form that is exposed in FIG. 3, (the portion containing the die cut), e.g. to apply data relating to transactions in a particular account of a particular intended recipient, and to apply the name and address of the intended recipient who is responsible for the particular account, i.e. an initial sen.d-to address 114 to the front panel of the return envelope, in the southeast quadrant in an inverted relation to the returning mail-to address 112 which was pre-printed on the same panel. The variable information printed on the right half of the sheet 10 at this stage preferably has the same orientation as the return "From" address 114 and the graphics and/or infor- mation pre-printed on the potential OCR remittance document 48.

Figure 4:
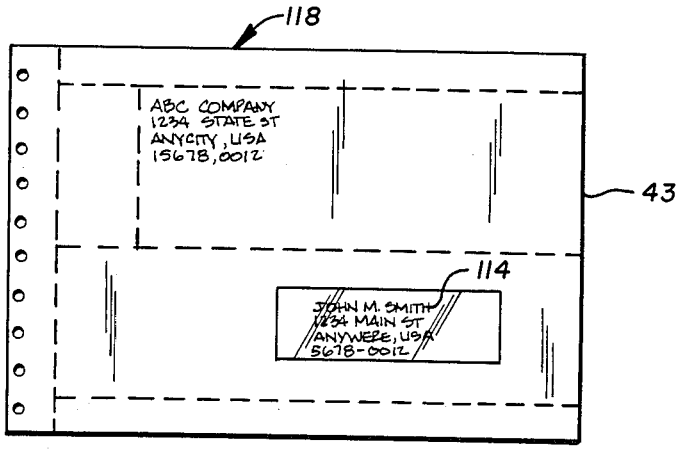
FIG. 4 is a front elevation view of the folded and sealed mailer having the initial mail-to address showing through the glassine-glazed window aperture.
Figure 6:
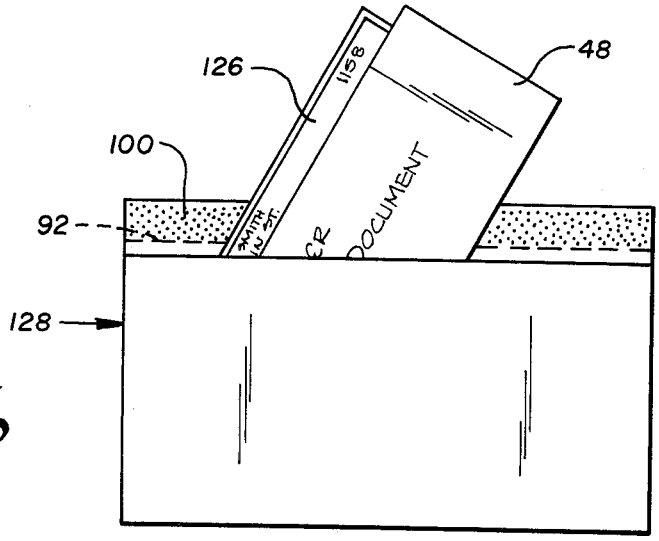
FIG. 6 is a rear elevational view of the return envelope with the remittance document and a form of payment being tucked into the pocket of the envelope so the glue flap can be folded over and sealed closed.

In any event, the form stock is doubled over on itself along the medial line of weakness 43, run through a heat sealer and hot pressed therein to produce closed and sealed mailers 118. If, at this stage, the mailers are still serially connected in composite web form, they are serially severed to cause them to become individual mailers ready to be mailed to the initial send-to addressees, the addresses 114 for whom are visible through the respective windows 50 (FIG. 4). (The intial return address may be pre-printed in the customary northwest quadrant location on the outer face of the left half of the sheet 10, so that it appears in its conventional location and orientation when the mailer is sent (FIG. 4).)

Upon receipt of a mailer 118, the user opens it, in accordance with instructions printed on its outside, by severing the top, bottom and left composite marginal strips 120, 122, 124 along the respective superimposed lines of weakness, 'butterflies' the mailer to an open condition about the medial line of weakness 43, and severs the mailer into two parts along this line of weakness. Next, continuing to follow instructions printed on the mailer, the user severs the OCR-readable remittance document 48 from the discardable remainder of the respective mailer part along the lines of weakness 44, 46, fills in any data (such as the amount of payment being enclosed) called for on the remittance document and prepares a form of payment such as a bank check 126 to return to the sender with the completed remittance document.

As to the other part of the mailer, in order to create a return mailing, the user, following printed instructions, severs the discard strip 54 along the lines of weakness 52, inserts the remittance document 48 and the form of payment 126 in the return envelope 128, wets the glue 100, and folds over the flap 98 about the line of weakness 92 and seals it to the outside of the rear panel of the return envelope. The return envelope now automatically bears exposed on its front panel, at a site prescribed for automated processing, the return send-to address at 114, and, in the prescribed northwest quadrant location, but in a believed-acceptable inverted orientation, the initial mail-to address, as a return 'from' address, the removal of the cover sheet preferably also having exposed beside this address the originally obscured right-side-up word "FROM", or a legend having a similar meaning.

Although the construction which has been illustrated is preferred, a similar mailer could be prepared using three sheets, the outer two of which are secured along the margin corresponding to the folded line of weakness 43, by a band of glue provided between corresponding marginal extensions of these two sheets, by two bands of glue provided between corresponding marginal extensions of these two sheets and a corresponding marginal extension of the inner sheet. The mailer in either form may be provided with one or more enclosed sheets.

To reiterate in summary form, and in other words, in manufacturing the mailer, a sheet is provided, intended to be later folded along a vertical line midway between the left and right ends. A second sheet is provided, which overlies the lefthand one-half of the bottom sheet. A return send-to address is pre-printed in an inverted manner on the top surface of the second sheet in the upper left-hand quadrant thereof. This field bears the name and address of the entity which is to receive the return envelope. The name and address of the initial addressee of the mailer is variably printed in the lower right quadrant of this face of the second sheet.

The right half of the bottom sheet is provided with a window which is positioned to expose the return envelope return addressee as a mailer send-to addressee when the right half of the bottom sheet is folded over the top of the second sheet. In this way an outgoing mailer is provided with the name and address of the original addressee visible through the window.

Upon receipt, the original addressee removes the top sheet of the envelope as received. This top sheet was originally the right half of the bottom sheet. The addressee is now left with a return envelope, which consists of the left half of the bottom sheet, and the second sheet.

In using the return envelope, the pre-printed return send-to address is exposed by removal of the second sheet, and the initial send-to address, now positioned at the upper left, functions as a return envelope sender's address. The fact that the 'from' address on the return envelope is inverted in relation to the return envelope send-to address (the postage or franking indicia being in the usual upper right corner location) further serves to prevent postal service OCR's from mis-reading the return envelope 'from' address as a return envelope send-to address.

It should now be apparent that the windowed mailer with tumble-style return envelope for remittance document, having return mail-to address exposed by removal of apertured cover as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A mailer, comprising:

two rectangular, transversally-elongated outer sheet means initially joined to one another about at least two opposite ones of four corresponding marginal edges of each, and a rectangular, transversally-elongated inner sheet means sandwiched between said two outer sheet means and initially adhesively joined to one of said two outer sheet means along three corresponding marginal edges including two relatively short longitudinal edges and one relatively long transverse edge to define a potential return envelope;

the other of said two outer sheet means including a fully cut-out window aperture;

an initial mail-to address printed on said inner sheet means, said initial mail-to address being disposed in registration with said window aperture so as to be readable externally of said mailer through said window aperture; and a return envelope mail-to address printed on said inner sheet means, said return envelope mail-to address being disposed out of registration with said window aperture so as to be obscured by said other of said two outer sheet means until said other of said two outer sheet means is separated from said one of said two outer sheet means along at least one of said at least two opposite ones of said four corresponding marginal edges;

said initial mail-to address being located on said inner sheet means in inverted relation to said return envelope mail-to address, and, relative to said return envelope mail-to address when in a right-side-up orientation, upside-down, above and to the left.

2. The mailer of claim 1, further including:

means provided about all four marginal edges of said two outer sheet means for severance to detach said other outer sheet means from said potential return envelope, while leaving said one outer sheet means and said inner sheet means of said potential return envelope joined along said three corresponding marginal edges thereof.

3. The mailer of claim 2, further including:

a legend printed on said inner sheet means, said legend being juxtaposed with said initial mail-to address, being disposed out of registration with said window aperture so as to be obscured by said other of said two outer sheet means until said other of said two outer sheet means is separated from said one of said two outer sheet means along at least one of said at least two opposite ones of said four corresponding marginal edges, and indicating that said initial mail-to address is to be interpreted to be a return envelope sender's address.

4. The mailer of claim 3, further including:

a place-postage-here legend or postal franking indicia printed on said inner sheet means on a same face, non-diagonally, transversally opposite corner from said initial mail-to address, this legend or indicia being disposed out of registration with said window aperture so as to be obscured by said other of said two outer sheet means until said other of said two outer sheet means is separated from said one of said two outer sheet means along at least one of said at least two opposite ones of said four corresponding marginal edges.

5. The mailer of claim 3, wherein:

said initial mail-to address is an impact printed address.

6. The mailer of claim 3, wherein:

said inner sheet means includes along a fourth marginal edge thereof a fold-over and seal glue flap.

7. The mailer of claim 3, wherein:

said window aperture is glazed by transparent, translucent or clear flexible sheet means.

8. The mailer of claim 3, wherein:

said two outer sheet means are adhesively joined to one another along three corresponding marginal edges of each, and are integrally hingedly joined to one another along a fourth corresponding marginal edge of each.

9. The mailer of claim 8, wherein:

said two outer sheet means are provided in common with a line of weakness along said fourth marginal edge of 10. Mailer stock, comprising:

two rectangular, transversally-elongated outer sheet means intially joined to one another along one of four corresponding marginal edges thereof and being foldable along said one marginal edge to provide a doubled-over outer sheet means;

said outer sheet means being provided marginally of the respective three other marginal edges thereof with means for joining said marginal edges to one another, in pairs of corresponding edges, after said two outer sheet means have been folded along said one marginal edge;

a transversally-elongated inner sheet means superimposed on one of said two outer sheet means and arranged to become sandwiched between said two outer sheet means as said two outer sheet means are folded along said one marginal edge of each, said inner sheet means being initially adhesively joined to said one of said two outer sheet means along three corresponding marginal edges of each including two relatively short longitudinal edges and one relatively long transverse edge to define a potential return envelope;

the other of said two outer sheet means including a fully cut-out window aperture;

said inner sheet means being provided, at a site which becomes disposed in registration with said window aperture after said two outer sheet means have been folded along said one marginal edge, with an initial mail-to address reception area adapted to have an initial mail-to address applied thereto so as to be then readable externally of said other of said two outer sheet means through said window aperture;

a return envelope mail-to address printed on said inner sheet means, said return envelope mail-to address being disposed to be out of registration with said window aperture after said two outer sheet means have been folded along said one marginal edge, so as to be then obscured by said other of said two outer sheet means until said other of said two outer sheet means is removed from sandwiching relation to said inner sheet means;

said initial mail-to address reception area being located on said inner sheet means, relative to said return envelope mail-to address when said return envelope mail-to address is in right-side-up orientation in position for an initial mail-to address, when received thereat, to serve as a return envelope sender's address.

11. The mailer stock of claim 10, further comprising:

means provided about all four marginal edges of said two outer sheet means for severance to detach said other outer sheet means from said potential return envelope, while leaving said one outer sheet means and said inner sheet means of said potential return envelope joined along said three corresponding marginal edges thereof.

12. The mailer stock of claim 11, further including:

a legend printed on said inner sheet means, said legend being juxtaposed with said initial mail-to address reception area, being disposed to be out of registration with said window aperture after said two outer sheet means have been folded along said one marginal edge, so as to be then obscured by said other of said two outer sheet means until said other of said two outer sheet means is removed from sandwiching relation to said inner sheet means, and indicating that said initial mail-to address is to be interpreted to be a return envelope sender's address.

13. The mailer stock of claim 12, further including:

a place-postage-here legend or postal franking indicia printed on said inner sheet means on a same face, non-diagonally, transversally opposite corner from said initial mail to address reception site, this legend or indicia being disposted to be out of registration with said window aperture after said two outer sheet means have been folded along said one marginal edge, so as to be then obscured by said other of said two outer sheet means until said other of said two outer sheet means is removed from sandwiching relation to said inner sheet means.

14. The mailer stock of claim 12, wherein:

said other of said two outer sheet means is printed on a face thereof which is disposed to confront said inner sheet means after said two outer sheet means have been folded along said one marginal edge, with OCR remittance stub indicia means which is inverted in heading relative to said return envelope mail-to address.

15. The mailer stock of claim 12, wherein:

said inner sheet means includes along a fourth marginal edge thereof a fold-over and seal glue flap.

16. The mailer stock of claim 12, wherein:

said window aperture is glazed by transparent, translucent or clear flexible sheet means.

17. The mailer stock of claim 12, wherein:

said two outer sheet means are adapted by a C-shaped band of adhesive applied to at least one of them to be adhesively joined to one another along three corresponding marginal edges of each, and are integrally hingedly joined to one another along a fourth corresponding marginal edge of each.

18. The mailer stock of claim 17, wherein:

said two outer sheet means are provided in common with a line of weakness along said fourth marginal edge of each.

* * * * *